US005429252A

United States Patent [19]

Liu

[11] Patent Number: 5,429,252

[45] Date of Patent: Jul. 4, 1995

[54] VERSATILE RAIL FOR SUPPORTING OBJECTS IN KITCHEN

[76] Inventor: Hung-Yang Liu, No. 32, Alley 48, Lane 179, Sec. 2, Nei Hu Rd., Taipei, Taiwan

[21] Appl. No.: 146,304

[22] Filed: Nov. 2, 1993

[51] Int. Cl.[6] ..... A47F 5/00

[52] U.S. Cl. ..... 211/94; 211/88; 211/105.1

[58] Field of Search ..... 211/87, 88, 105.1, 94, 211/175; 312/246; 248/225.1, 298

[56] References Cited

U.S. PATENT DOCUMENTS

| | | | |
|---|---|---|---|
| 1,613,447 | 1/1927 | Ellberg | 211/87 X |
| 1,616,957 | 2/1927 | Honigbaum | 211/87 X |
| 2,705,566 | 4/1955 | Ford et al. | 211/105.1 |
| 2,715,966 | 8/1955 | Tieck | 211/94 |
| 3,286,850 | 11/1966 | Ruhnke | 211/105.1 |
| 3,313,424 | 4/1967 | Gingher | 211/94 X |
| 4,226,394 | 10/1980 | Einhorn | 248/225.1 |
| 4,771,897 | 9/1988 | Ho | 211/94 X |
| 4,869,378 | 9/1989 | Miller | 211/94 |
| 4,899,971 | 2/1990 | Elkin | 211/88 X |

*Primary Examiner*—Robert W. Gibson, Jr.
*Attorney, Agent, or Firm*—Kirkpatrick & Lockhart

[57] ABSTRACT

A rail including a number of slots being longitudinally formed therein and a number of options each including a guide being slidably engageable in the slots. Each slot consists of a wide portion and a narrow portion. The wide portion of each slot is proximate to the axis of the rail while the narrow portion of the same is distal from the axis of the rail. Each guide has a form being compensative to that of each slot. Thus, each option will not be radially disengaged from the rail when the guide of the option is engaged in a corresponding slot formed in the rail.

9 Claims, 6 Drawing Sheets

VERSATILE RAIL FOR SUPPORTING OBJECTS IN KITCHEN

BACKGROUND OF INVENTION

1. Field of Invention

The present invention relates to a versatile rail for supporting objects in a kitchen, e.g., hooks and trays.

2. Related Prior Art

There are often a sink, a preparation table and a cabinet in a kitchen. Preparation utensils are disposed on the preparation table and in the cabinet. However, it is inconvenient to take preparation utensils from the cabinet which is closed by a door. It is easy to take preparation utensils from the preparation table, but such preparation utensils occupy too much space of the preparation table, thereby causing troubles for the preparation of food. Therefore, there is a long unfulfilled need to provide a device for supporting objects in a kitchen.

SUMMARY OF INVENTION

It is an object of the present invention to provide a rail for supporting hooks for hooking preparation utensils.

It is another object of the present invention to provide a rail for supporting trays for supporting objects.

It is still another object of the present invention to provide a rail for supporting various options for supporting various objects.

The above-mentioned objects and other objects of the present invention are achieved by providing a rail including a number of slots longitudinally formed therein and a number of options each including a guide being slidably engageable in the slots. Each slot consists of a wide portion and a narrow portion. The wide portion of each slot is proximate to the axis of the rail while the narrow portion of the same is distal from the axis of the rail. Each guide has a form being compensative to that of each slot. Thus, each option will not be radially disengaged from the rail when the guide of the option is engaged in a corresponding slot formed in the rail.

For a better understanding of the present invention and objects thereof, a study of the detailed description of the embodiments described hereinafter should be made in relation to the accompanying drawings.

DETAILED DESCRIPTION OF PREFERRED EMBODIMENT

Figure 1:
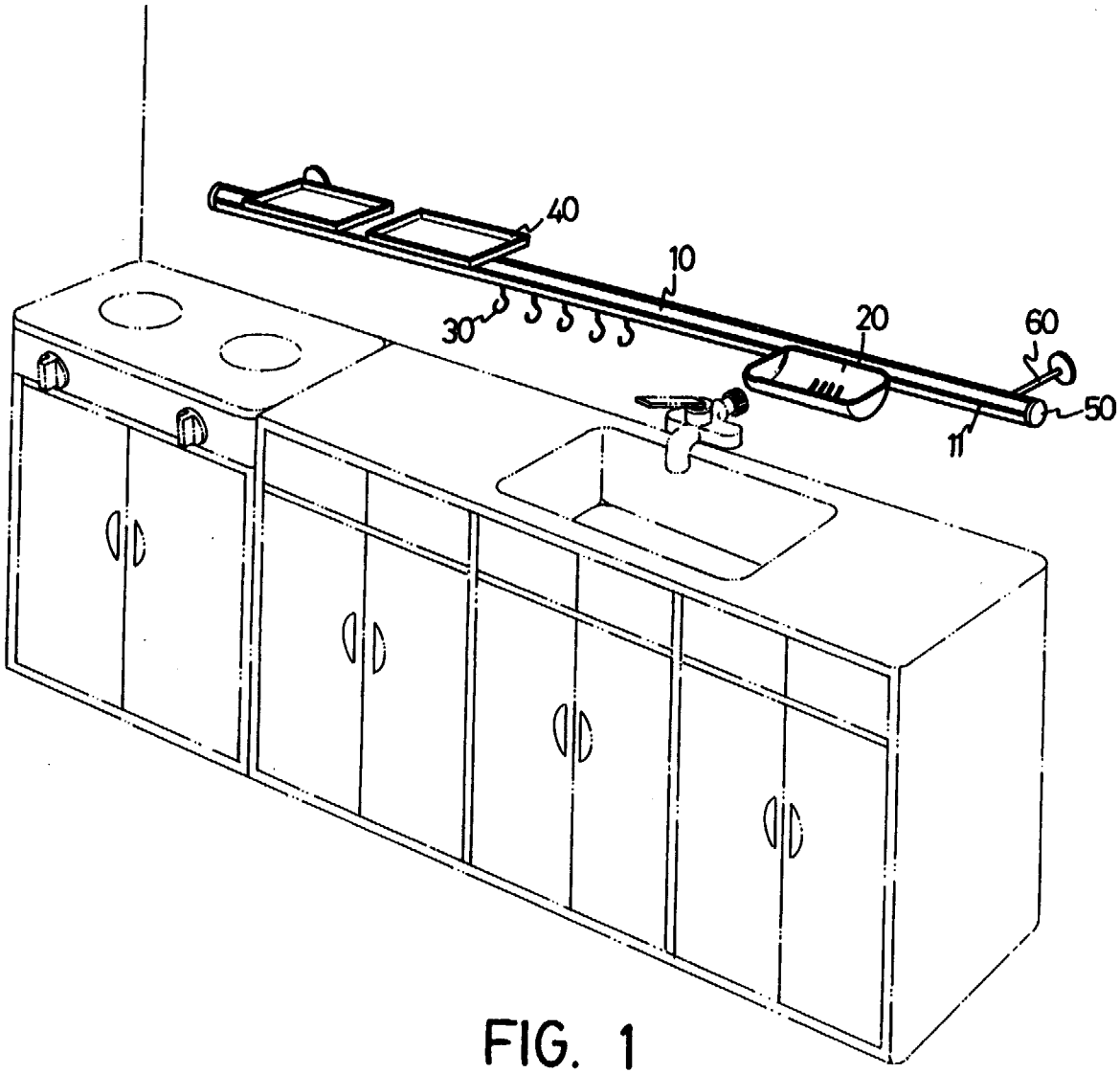
FIG. 1 is a front-right-top perspective view of a rail supporting a soap tray, a number of hooks and a number of trays in accordance with the preferred embodiment of the present invention.
Figure 2:
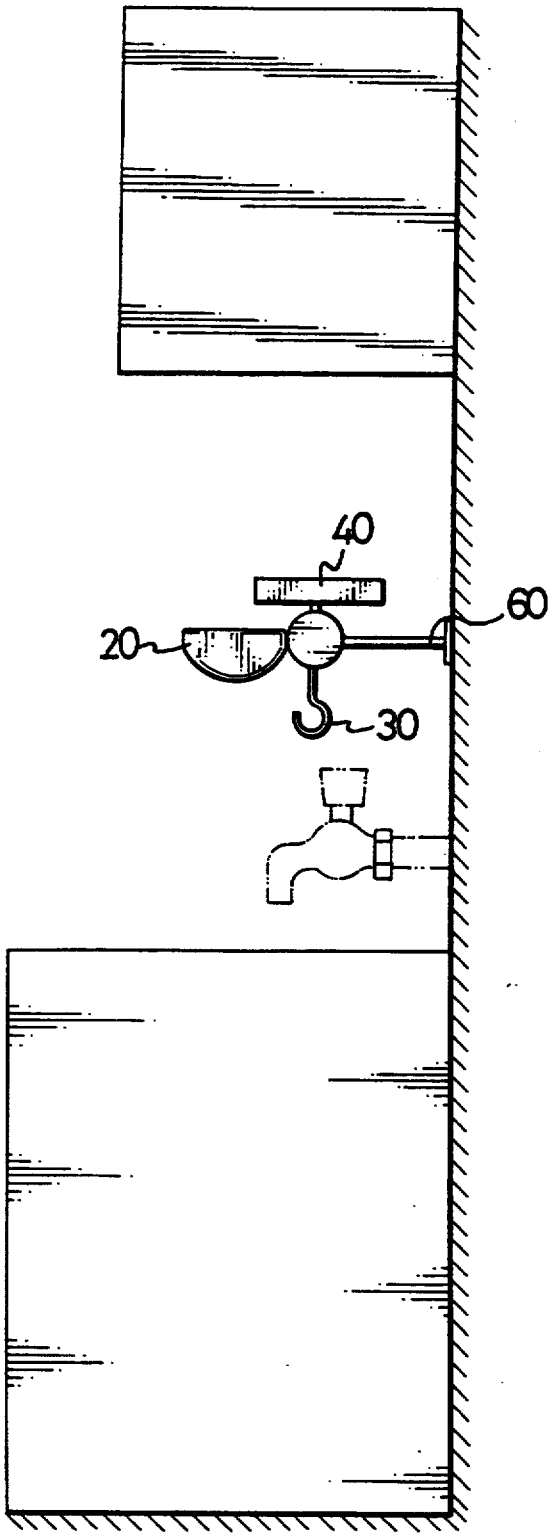
FIG. 2 is a right side view of the rail to which a soap tray, a number of hooks and a number of trays are attached in accordance with the preferred embodiment of the present invention.

Referring to FIGS. 1 and 2, a rail 10 is attached by means of two brackets 60 to a wall in a kitchen. The rail 10 is about 45 centimeters above a preparation table so that objects being supported by options being attached to the rail 10 is steadily available for users. As shown for example, a soap tray 20, a number of hooks 30 and a number of trays 40 are attached to the rail 10.

Figure 3:
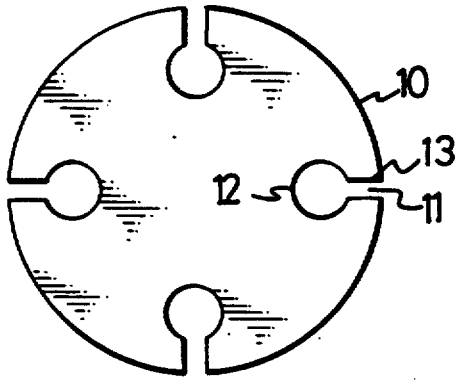
FIG. 3 is a right side view of the rail in accordance with the preferred embodiment of the present invention.

Referring to FIG. 3, four slots 11 are longitudinally formed throughout the rail 10. Each slot 11 is 90° from the next slot 11. For the convenience of description, the four slots are referred to as front, rear, upper and lower slots. Each slot 11 has a circular portion being in communication with a rectilinear portion.

Figure 4:
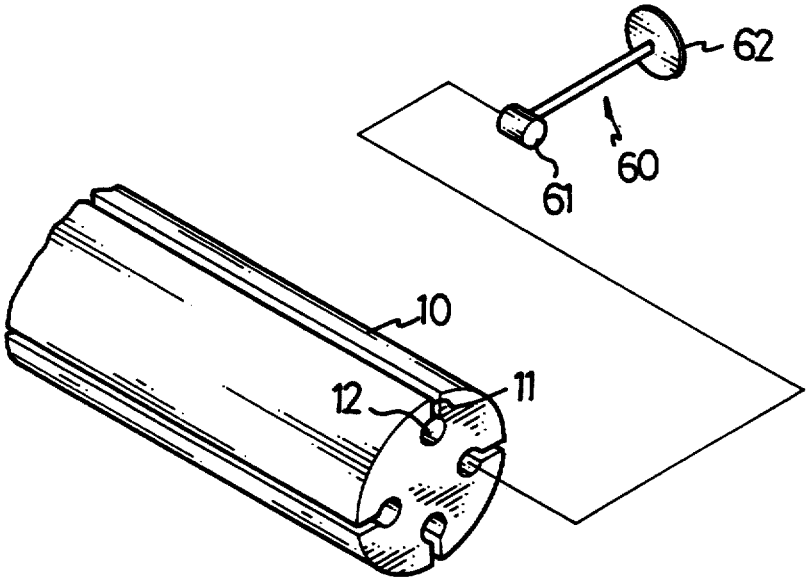
FIG. 4 is an enlarged view of engagement between the rail and two brackets in accordance with the preferred embodiment of the present invention.

Referring to FIG. 4, a guide 61 is formed on an end of each bracket 60 and a base 62 is formed on an opposite end of the bracket 60. Each guide 61 has a form being compensatory to that of each slot 11. Thus, the guides 61 are slidably engageable in the rear slot 11, i.e. the rail 10 is attached to the brackets 60. Furthermore, the brackets 60 will cannot radially detached from the rail 10 because of the mutually compensatory configurations of the slots 11 and the guides 61. Several holes are formed through the base Of each bracket 60. Several screws or nails (not shown) are inserted through the holes formed through the base 62 of each bracket and are secured to the wall. Thus, the rail 10 is attached by means of the brackets 60 to the wall.

Figure 5:
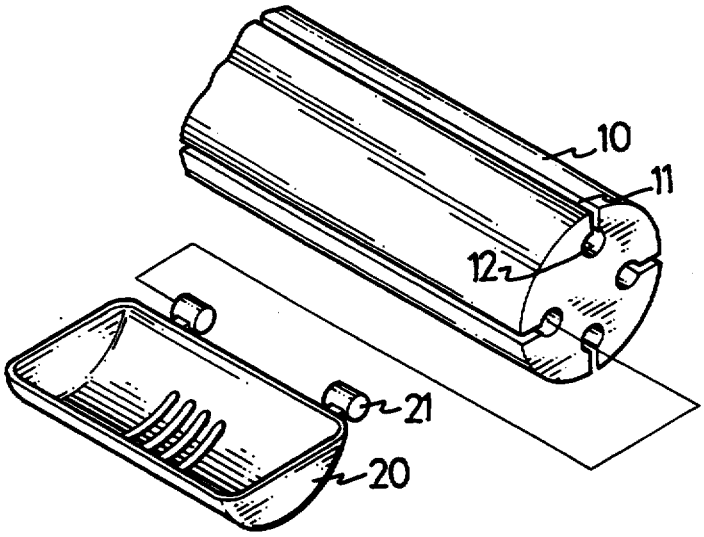
FIG. 5 is an enlarged view of engagement between the rail and the soap tray in accordance with the preferred embodiment of the present invention.
Figure 6:
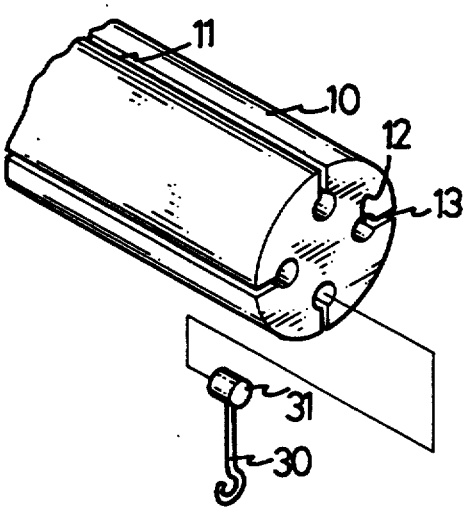
FIG. 6 is an enlarged view of engagement between the rail and a hook in accordance with the preferred embodiment of the present invention.
Figure 7:
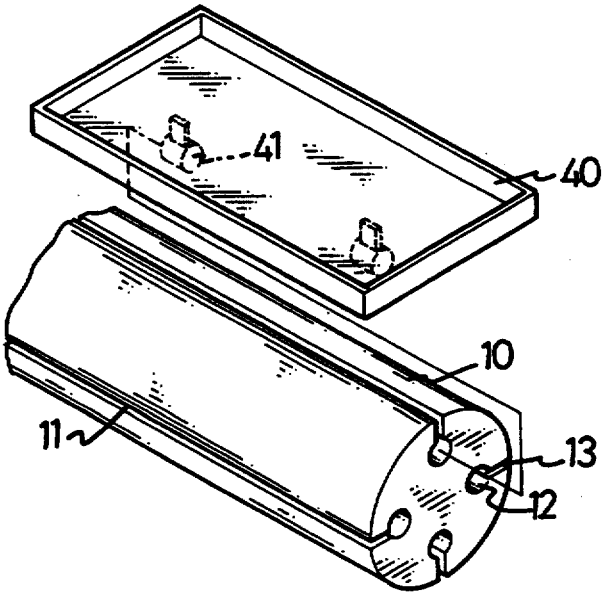
FIG. 7 is an enlarged view of engagement between the rail and a tray in accordance with the preferred embodiment of the present invention.

Referring to FIG. 5, two guides 21 are formed on an edge of the soap tray 20. Referring to FIG. 6, a guide. 31 is formed on each hook 30. Referring to FIG. 7, two guides 41 are formed on the underside of each tray 40. The guides 21, 31 and 41 has a configuration being identical to that of each guide 60 so that they are slidably engageable in the slots 11.

The guides 21 are engaged in the front slot 11, i.e., the soap tray 20 is attached to the front side of the rail 10. Obviously, a bending moment is exerted on each guide 21 as a load is exerted on the soap tray 20. The moment might break the guides 21. Therefore, such an arrangement of the soap tray 20 is not durable for a heavy load.

The guides 31 are engaged in the lower slot 11. Thus, the hooks 30 are attached to the underside of the rail 10 in order to retain preparation utensils or other objects in position to the rail 10.

The guides 41 are engaged in the upper slot 11, i.e., the trays 40 are attached to the upperside of the rail 10. Obviously, there will not be any bending moment exerted on each guide 41 if a load is exerted on each tray 40. Thus, the tray 40 is suitable for taking a heavy load.

Figure 8:
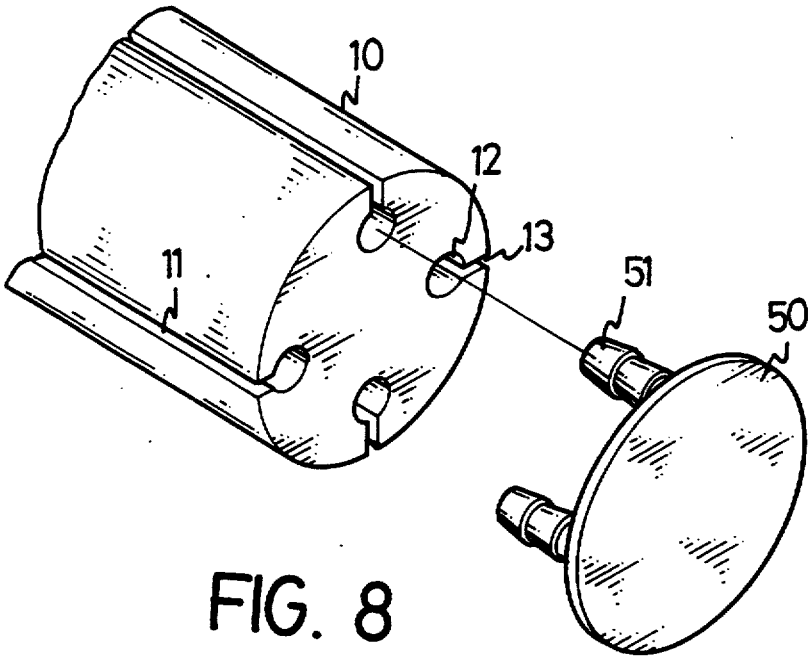
FIG. 8 is an enlarged view of a slot-plugging member being engageable in four slots being longitudinally formed in the rail in accordance with the preferred embodiment of the present invention.

Referring to FIG. 8, a slot-plugging member 50 has a flat portion from a side of which four plugs 51 project. The plugs 51 are fitted in the circular portions of the slots 11. Thus, the guides 21, 31 and 41 are kept from sliding out of the slots 11, i.e., the soap tray 20, the hooks 30 and the trays 40 are retained attached to the rail 10. Furthermore, the guide 61 is kept from sliding out of the rear slot 11, i.e., the rail 10 is retained mounted on the brackets 60.

Figure 9:
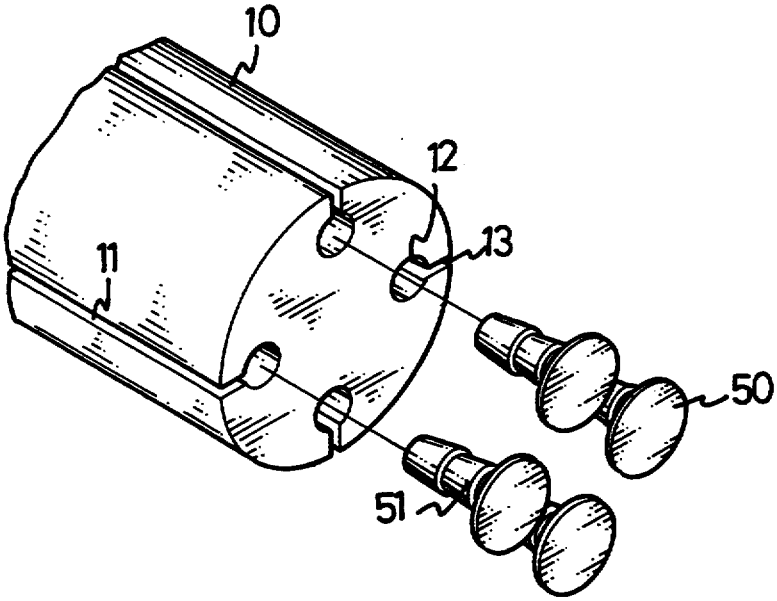
FIG. 9 is an enlarged view of four plugs being engageable in the slots being longitudinally formed in the rail in accordance with the preferred embodiment of the present invention.

Referring to FIG. 9, four plugs 52 are each fitted in the circular portion of a corresponding slot 11 so that the soap tray 20, the hooks 30 and the trays 40 are retained attached to the rail 10 and that the rail 10 is retained mounted on the brackets 60.

Figure 10:
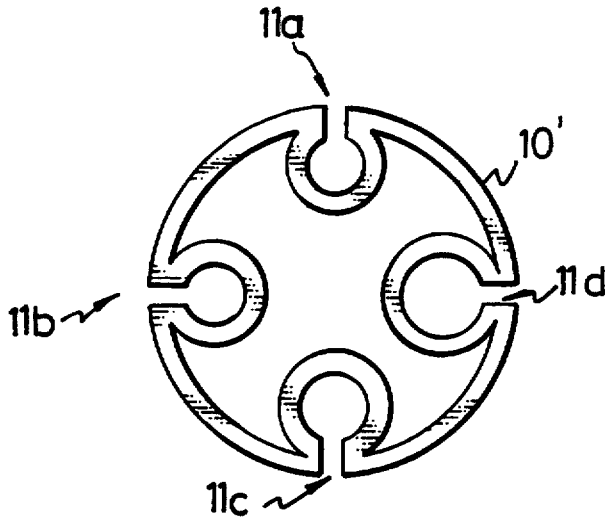
FIG. 10 is a right side view of a rail in accordance with another embodiment of the present invention.

Referring to FIG. 10, in accordance with another embodiment of the present invention, a rail 10' is tubular. Four slots 11*a*, 11*b*, 11*c* and 11*d* are longitudinally formed throughout the rail 10'. The slots 11*a*, 11*b*, 11*c* and 11*d* are made with different sizes. Obviously, the guides must be dimensioned to match the slots.

While the present invention has been explained in relation to its preferred embodiment, it is to be understood that variations thereof will be apparent to those skilled in the art upon reading this specification. Therefore, the present invention is intended to cover all such variations as shall fall within the scope of the appended claims.

I claim:

1. A rail/option assembly being mounted on a wall and comprising a rail, at least one option and two brackets, the rail comprising a front slot defined longitudinally therethrough and a rear slot defined longitudinally therethrough, the option comprising at least one guide formed thereon with a compensatory form of the front slot, each of the brackets comprising a guide formed at an end thereof and a base formed at an opposite end thereof so that the guide of each of the brackets is engageable in the rear slot for mounting the rail on the brackets and that the base of each of the brackets is attachable to the wall by securing means.

2. A rail/option assembly in accordance with claim 1 wherein the slot comprising a wide portion being in communication with a narrow portion, the wide portion of the slot being proximate to the axis of the rail, the narrow portion of the slot being distal from the axis of the rail.

3. A rail/option assembly in accordance with claim 1 comprising two brackets for mounting the rail on the wall.

4. A rail/option assembly in accordance with claim 1 wherein the rail further comprises a lower slot and an upper slot so that the four slots are 90° to the next slot.

5. A rail/option assembly in accordance with claim 4 comprising two slot-plugging members each comprising a flat portion and four plugs projecting from the flat portion, the plugs being fitted in the slots in order to retain the guides in the slots.

6. A rail/option assembly in accordance with claim 4 comprising eight plugs each being fitted in a corresponding one of the slots.

7. A rail/option assembly in accordance with claim 1 wherein the option is a soap tray comprising two guides formed on an edge thereof.

8. A rail/option assembly in accordance with claim 1 wherein the option is a hook.

9. A rail/option assembly in accordance with claim 1 wherein the option is a tray comprising two guides formed on the underside thereof.

* * * * *